US011261723B2

(12) United States Patent
Evans et al.

(10) Patent No.: US 11,261,723 B2
(45) Date of Patent: Mar. 1, 2022

(54) ELECTRONIC CONNECTIONS IN A DRILL STRING AND RELATED SYSTEMS AND METHODS

(71) Applicant: Baker Hughes Oilfield Operations LLC, Houston, TX (US)

(72) Inventors: Kenneth R. Evans, Spring, TX (US); Juan Miguel Bilen, The Woodlands, TX (US); Jason R. Habernal, Magnolia, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 85 days.

(21) Appl. No.: 16/711,020

(22) Filed: Dec. 11, 2019

(65) Prior Publication Data

US 2021/0180412 A1 Jun. 17, 2021

(51) Int. Cl.

| | |
|---|---|
| ***E21B 47/017*** | (2012.01) |
| ***E21B 17/02*** | (2006.01) |
| ***E21B 47/013*** | (2012.01) |
| ***E21B 49/00*** | (2006.01) |
| ***E21B 10/42*** | (2006.01) |
| *E21B 10/567* | (2006.01) |

(52) U.S. Cl.

CPC ..... *E21B 47/017* (2020.05); *E21B 10/42* (2013.01); *E21B 17/028* (2013.01); *E21B 47/013* (2020.05); *E21B 49/003* (2013.01); *E21B 10/567* (2013.01)

(58) Field of Classification Search

CPC ..... E21B 17/028; E21B 47/017; E21B 10/42; E21B 49/003; E21B 10/567; E21B 47/013; E21B 47/01; E21B 47/0175

See application file for complete search history.

(56) References Cited

U.S. PATENT DOCUMENTS

| | | | | |
|---|---|---|---|---|
| 4,884,071 A | | 11/1989 | Howard | |
| 6,062,905 A | * | 5/2000 | Sampa | E21B 23/08 439/587 |
| 6,123,561 A | * | 9/2000 | Turner | E21B 17/028 439/194 |
| 8,893,822 B2 | * | 11/2014 | Trinh | E21B 10/00 175/50 |

(Continued)

FOREIGN PATENT DOCUMENTS

| | | |
|---|---|---|
| EP | 1583886 B1 | 9/2010 |
| WO | 2013/028744 A1 | 2/2013 |

OTHER PUBLICATIONS

International Search Report for International Application No. PCT/US2020/063813, dated Mar. 16, 2021, 3 pages.

(Continued)

*Primary Examiner* — Nicole Coy

(74) *Attorney, Agent, or Firm* — TraskBritt

(57) ABSTRACT

An earth-boring tool may include a tool body and a coupling region configured to couple the earth-boring tool to an adjacent portion of a drill string. The earth-boring tool may also include one or more sensors disposed on the tool body. The earth-boring tool may further include a connector disposed in the coupling region electrically connected to the one or more sensors. The connector may be configured to enable a removable connection from an external device to the one or more sensors.

20 Claims, 8 Drawing Sheets

(56) References Cited

U.S. PATENT DOCUMENTS

| | | | | |
|---|---|---|---|---|
| 8,967,295 | B2 * | 3/2015 | Habernal | E21B 47/01 175/40 |
| 9,328,561 | B2 * | 5/2016 | Trinh | E21B 10/00 |
| 9,534,455 | B2 * | 1/2017 | Peters | E21B 17/03 |
| 2018/0038171 | A1 | 2/2018 | Hall et al. | |
| 2021/0108468 | A1 * | 4/2021 | Prakash | H01R 13/631 |

OTHER PUBLICATIONS

International Written Opinion for International Application No. PCT/US2020/063813, dated Mar. 16, 2021, 5 pages.

* cited by examiner

ELECTRONIC CONNECTIONS IN A DRILL STRING AND RELATED SYSTEMS AND METHODS

TECHNICAL FIELD

Embodiments of the present disclosure generally relate to earth-boring operations. In particular, embodiments of the present disclosure relate to electrical connections on a drill string.

BACKGROUND

Various tools are used in hydrocarbon exploration and production to measure properties of geologic formations during or shortly after the excavation of a borehole. The tools often include various electronic devices such as sensors, controllers, communication devices, etc. Many of the electronic devices are located on a bottom hole assembly (BHA) that operates on a distal end of a drill string. The BHA often includes one or more earth-boring tools, such as drill bits, reamers, a motor (e.g., mud motor), and other components such as steering devices, etc. The BHA also frequently includes measurement-while-drilling (MWD) and/or logging-while-drilling (LWD) modules, which include electronic components. The BHA often operates in harsh environments having high temperatures, high pressures, and significant amounts of vibration.

Each earth-boring tool in the BHA may include multiple electronic devices. The electronic devices in each earth-boring tool may be connected to adjacent earth-boring tools or components in the BHA. For example, some earth-boring tools and/or components in the BHA may include processors or memory storage devices configured to capture, process, and/or store data produced by sensors and/or electronic devices in adjacent earth-boring tools. Some earth-boring tools and/or components of the BHA may enable a connection from sensors in another earth-boring tool or component of the BHA to pass through the earth-boring tool or component to another component in the drill string.

The connections between earth-boring tools or components in the BHA may enable information collected by sensors downhole to be transmitted to other components in the BHA or drill string to provide information for adjusting control instructions, data logging, trajectory adjustments, tripping decisions, etc. Incorrect or missing data may result in significant losses of time and expense in an associated drilling operation.

BRIEF SUMMARY

Some embodiments of the present disclosure include an earth-boring tool. The earth-boring tool may include a tool body. The earth-boring tool may further include a coupling region configured to couple the earth-boring tool to an adjacent portion of a drill string. The earth-boring tool may also include one or more sensors disposed on the tool body. The earth-boring tool may further include a connector disposed in the coupling region electrically connected to the one or more sensors. The connector may be configured to enable a removable connection from an external device to the one or more sensors.

Another embodiment of the present disclosure may include a drill string. The drill string may include an earth-boring tool. The earth-boring tool may include a tool body. The earth-boring tool may further include a coupling region configured to couple the earth-boring tool to an adjacent portion of the drill string. The earth-boring tool may also include one or more sensors disposed in the drill string. The earth-boring tool may further include a connector disposed in the coupling region of the earth-boring tool electrically coupled to the one or more electronic devices. The drill string may further include a complementary connector disposed in the adjacent portion of the drill string. The complementary connector may be electrically coupled to a data processing device. The connector and the complementary connector may be configured to electrically couple the one or more electronic devices to the data processing device.

Another embodiment of the present disclosure may include a method of building an earth-boring tool. The method may include selecting an earth-boring tool blank. The method may further include securing one or more electrical devices to the earth-boring tool blank. The method may also include extending electrical connections from the electrical devices through the earth-boring tool blank into a central region of the earth-boring tool blank. The method may further include electrically coupling the electrical connections semi-permanently to a connector. The method may also include disposing the connector into a coupling region of the earth-boring tool blank. The connector may be configured to enable a removable connection between the electrical devices and another earth-boring tool component.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular earth-boring system or component thereof, but are merely idealized representations employed to describe illustrative embodiments. The drawings are not necessarily to scale.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

As used herein, the term "coupled" means and includes any operative connection and may include a connection through an intermediary connection or element. As used herein, the term "directly coupled" means and includes a direct connection between two elements without an intermediary connection or device.

Figure 1:
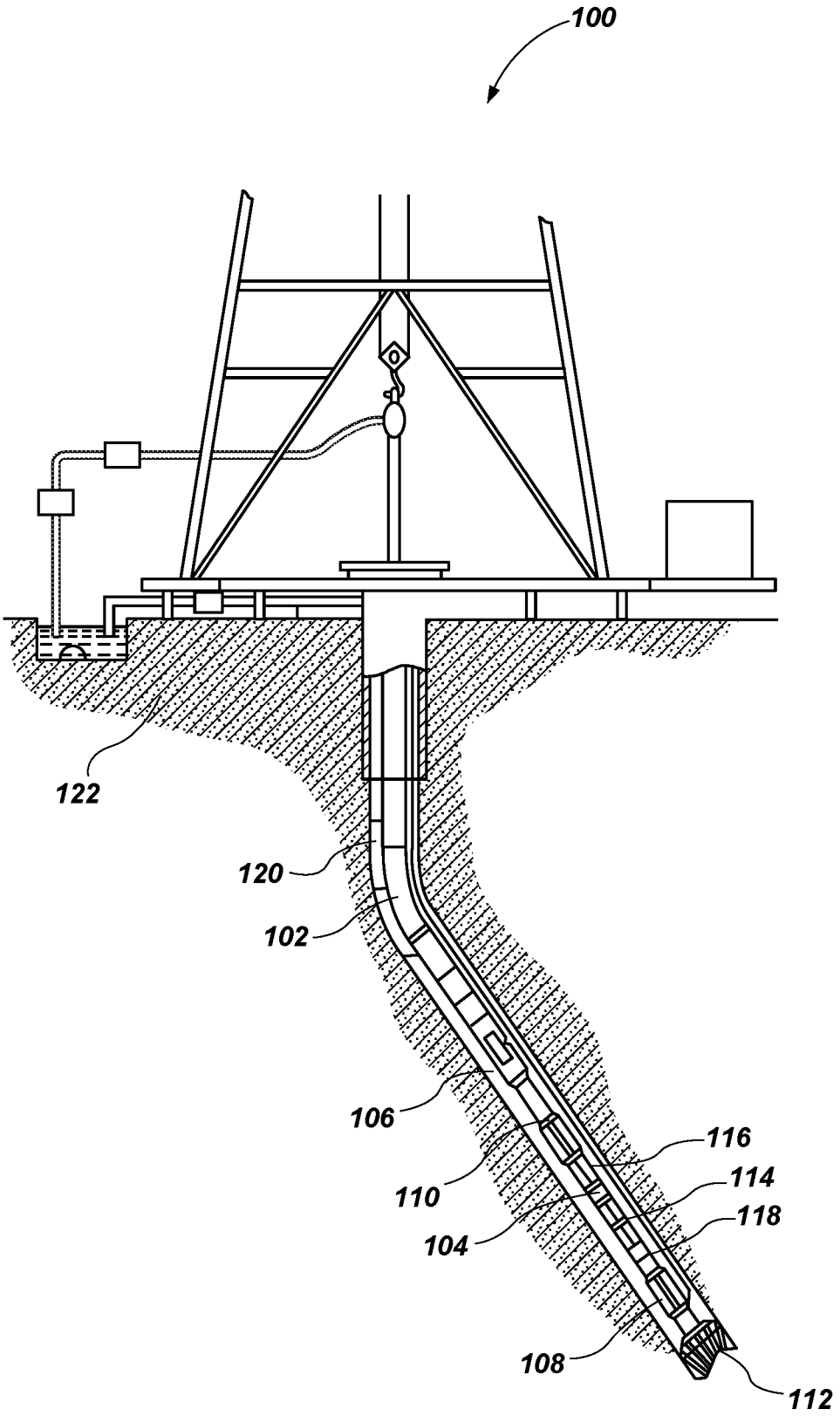
FIG. 1 illustrates an earth-boring system in accordance with an embodiment of the present disclosure.

FIG. 1 illustrates an earth-boring system 100. An earth-boring system 100 may include a drill string 102. The drill string 102 may include multiple sections of drill pipe coupled together to form a long string of drill pipe. A forward end of the drill string 102 may include a bottom hole assembly 104 (BHA). The BHA 104 may include components, such as a motor 106 (e.g., mud motor), one or more reamers 108 and/or stabilizers 110, and an earth-boring tool 112 such as a drill bit. The BHA 104 may also include electronics, such as sensors 114, modules 116, and/or tool control components 118. The drill string 102 may be inserted into a borehole 120. The borehole 120 may be formed by the earth-boring tool 112 as the drill string 102 proceeds through a formation 122. The tool control components 118 may be configured to control an operational aspect of the earth-boring tool 112. For example, the tool control components 118 may include a steering component configured to change an angle of the earth-boring tool 112 with respect to the drill string 102 changing a direction of advancement of the drill string 102. The tool control components 118 may be configured to receive instructions from an operator at the surface and perform actions based on the instructions. In some embodiments, control instructions may be derived downhole within the tool control components 118, such as in a closed loop system, etc.

The sensors 114 may be configured to collect information regarding the downhole conditions such as temperature, pressure, vibration, fluid density, fluid viscosity, cutting density, cutting size, cutting concentration, etc. In some embodiments, the sensors 114 may be configured to collect information regarding the formation, such as formation composition, formation density, formation geometry, etc. In some embodiments, the sensors 114 may be configured to collect information regarding the earth-boring tool 112, such as tool temperature, cutter temperature, cutter wear, weight on bit (WOB), torque on bit (TOB), string rotational speed (RPM), drilling fluid pressure at the earth-boring tool 112, fluid flow rate at the earth-boring tool 112, etc.

The information collected by the sensors 114 may be processed, stored, and/or transmitted by the modules 116. The modules 116 may be located in multiple locations within the BHA 104 and along the drill string 102, such as in the earth-boring tool 112, in the tool control components 118, in the reamer 108, in the stabilizers 110, etc. For example, the modules 116 may receive the information from the sensors 114 in the form of raw data, such as a voltage (e.g., 0-10 VDC, 0-5 VDC, etc.), an amperage (e.g., 0-20 mA, 4-20 mA, etc.), or a resistance (e.g., resistance temperature detector (RTD), thermistor, etc.). The module 116 may process raw sensor data and transmit the data to the surface on a communication network, using a communication network protocol to transmit the raw sensor data. The communication network may include, for example a communication line, mud pulse telemetry, electromagnetic telemetry, wired pipe, etc. In some embodiments, the modules 116 may be configured to run calculations with the raw sensor data, for example, calculating a viscosity of the drilling fluid using the sensor measurements such as temperatures, pressures or calculating a rate of penetration of the earth-boring tool 112 using sensor measurements such as cutting concentration, cutting density, WOB, formation density, etc.

In some embodiments, the downhole information may be transmitted to the operator at the surface or to a computing device at the surface. For example, the downhole information may be provided to the operator through a display, a printout, etc. In some embodiments, the downhole information may be transmitted to a computing device that may process the information and provide the information to the operator in different formats useful to the operator. For example, measurements that are out of range may be provided in the form of alerts, warning lights, alarms, etc., some information may be provided live in the form of a display, spreadsheet, etc., whereas other information that may not be useful until further calculations are performed may be processed and the result of the calculation may be provided in the display, print out, spreadsheet, etc.

Because the drill string 102 includes multiple components the electronic devices in each component must be coupled to or through adjacent components in the drill string. As the number of electronic devices in the drill string 102 increase the number of connections between each component of the drill string 102 also increase. Due to the extreme environment downhole, the connections between components must be robust connections capable of withstanding the vibrations, temperatures, and pressures downhole. In different operations, different electronic devices may be required in each component of the drill string 102. Therefore, unique connections may be required each time a component is connected, which may result in a time consuming process when connecting the components or changing out worn components. A universal connection in a body of a component of the drill string 102 may reduce the time required to connect, disconnect, and/or change components of the drill string 102. The universal connection may also reduce the complexity of changing components of the drill string 102, such that the process may be completed by a technician at a lower skill level. In some embodiments, the universal connection may further increase the reliability of the connections between the electronic devices in each component of the drill string 102.

Figure 2:
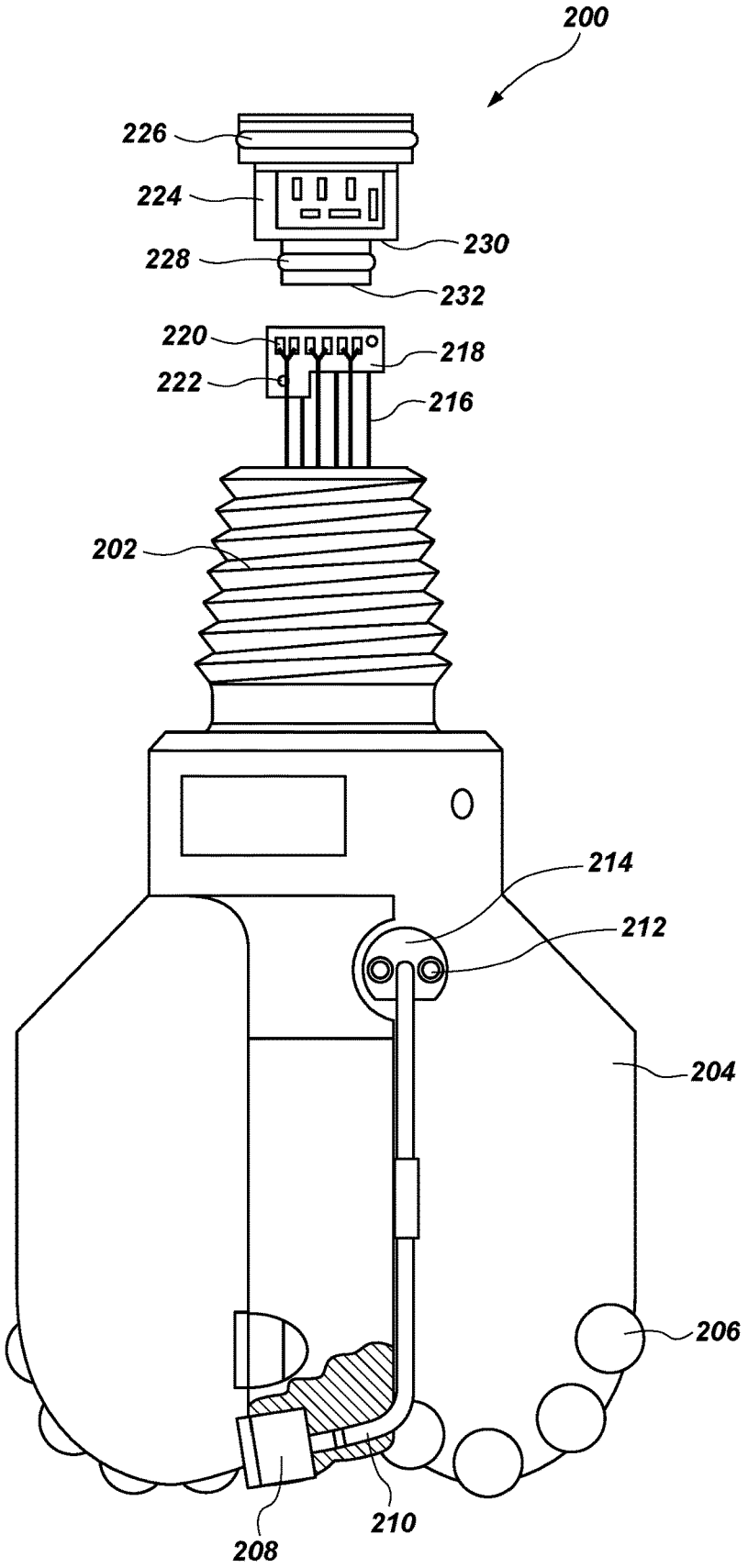
FIG. 2 illustrates an earth-boring tool in accordance with an embodiment of the present disclosure.

FIG. 2 illustrates an embodiment of an earth-boring tool 200. The earth-boring tool 200 of FIG. 2 comprises a fixed cutter drill bit, however, the earth-boring tool 200 may include other earth-boring tools, such as roller cone bits, hybrid bits, coring bits, percussion bits, bi-center bits, reamers (e.g., expandable reamers, fixed-wing reamers, mid-string reamers, etc.), casing shoes, stabilizers, etc. The earth-boring tool 200 may include a coupling region 202 and a tool body 204.

The tool body 204 may include one or more cutting elements 206 arranged around the tool body 204. The cutting elements 206 may be configured to interact with the formation. The cutting elements 206 may comprise, for example, a polycrystalline compact in the form of a layer of hard polycrystalline material, also known in the art as a polycrystalline table, that is provided on (e.g., formed on or subsequently attached to) a supporting substrate with an interface therebetween. In some embodiments, the cutting elements 206 may comprise polycrystalline diamond compact (PDC) cutting elements each including a volume of polycrystalline diamond material provided on a ceramic-metal composite material substrate, as is known in the art. Though the cutting elements 206 illustrated in the embodiment depicted in FIG. 2 are cylindrical or disc-shaped, the cutting elements 206 may have any desirable shape, such as a dome, cone, chisel, etc. In operation, the earth-boring tool 200 may be rotated about the central axis. As the earth-boring tool 200 is rotated under applied WOB, the cutting elements 206 may engage a subterranean formation such that the cutting elements 206 exceed a compressive strength of the subterranean formation and penetrate the formation to remove formation material therefrom in a shearing cutting action.

The tool body 204 may have one or more sensors 208 disposed within the tool body 204. The sensors 208 may be configured to detect downhole properties such as temperature, pressure, fluid flow, drilling fluid properties (e.g., composition, viscosity, temperature, pressure, etc.), formation properties (e.g., composition, density, strength, elasticity, etc.), operating parameters (e.g., weight on bit (WOB), rotational speed, torque on bit, direction, orientation, etc.), and tool properties (e.g., tool wear, cutter wear, tool temperature, vibration, etc.). In some embodiments, the sensors 208 may be positioned on a surface of the tool body 204. In some embodiments, the sensors 208 may be positioned within the tool body 204, such as within a cavity in the tool body 204. In some embodiments, the sensors 208 may be partially disposed within the tool body 204 such that a portion of the sensors 208 is exposed and another portion of the sensors 208 is shielded from the downhole environment by the tool body 204. In some embodiments, the tool body 204 may include one or more modules configured to process raw data from the sensors 208.

The sensors 208 may include wired connections 210. In some embodiments, the wired connections 210 may be configured to provide power to the sensors 208. In some embodiments, the wired connections 210 may be configured to transmit data, such as sensor readings, instruction, etc., to and/or from the sensors 208. For example, some sensors 208 may be unpowered sensors (e.g., resistance based sensors, passive sensors, capacitive sensors, etc.) configured to adjust a signal and/or generate a signal based on the detected properties. In some embodiments, some sensors 208 may be require an excitation voltage to generate a signal from the sensors 208. In another example, some sensors 208 may include a microprocessor and/or a memory configured to process raw data and provide a processed signal through the wired connections 210.

In some embodiments, the wired connections 210 may include a protective cover (e.g., jacket, conduit, etc.). For example, the wired connections 210 may be a bundle of individual wires running inside a jacket or a conduit through the tool body 204. The jacket or conduit may provide additional protection to the wired connections 210 from elements of the downhole environment, such as temperatures, pressures, vibrations, etc.

The wired connections 210 may pass through an internal passage 212 in the tool body 204 to a central region of the tool body 204. In some embodiments, the internal passage 212 may be formed into the tool body 204 when the tool body 204 is formed, such as during a molding process, casting process, forging process, etc. In some embodiments, the internal passage 212 may be formed in the tool body 204 after the initial forming process. For example, the internal passage 212 may be drilled or machined into the tool body 204. In some embodiments, the internal passage 212 may be configured to receive wired connections 210 from multiple sensors 208. In some embodiments, the internal passage 212 may include an insert 214 configured to provide a seal between the wired connections 210 and the internal passage 212. In some embodiments, the insert 214 may be configured to receive the wired connection 210 for each of the sensors 208 individually as jacketed groups of wires or groups of wires in separate conduits.

The wired connections 210 may enter the coupling region 202 of the earth-boring tool 200 through the central region of the tool body 204. The coupling region 202 of the earth-boring tool 200 may be configured to couple the earth-boring tool 200 to an adjacent component of the BHA or drill string. For example, the coupling region 202 may include a threaded component, such as an American Petroleum Institute (API) threaded connection, a stem, coupler, nipple, union, etc. In some embodiments, the coupling region 202 may include features configured to couple the earth-boring tool 200 to an adjacent component through an alternative coupling mechanism, such as a compression fitting, quick connect fitting, flange fitting, etc.

The wired connections 210 may combine with other wired connections 210 from other sensors 208 of the earth-boring tool 200 into centrally located tool wiring 216. The tool wiring 216 may be directly coupled to a connector 218 in the coupling region 202. For example, each individual wire in the tool wiring 216 may be coupled to individual terminal connections 220 in the connector 218. In some embodiments, the terminal connections 220 may be semi-permanent connections, such as soldered connections, brazed connections, punch-down connections, screw terminal connections, binding post connections; lug connections, compression connections (e.g., compression splice, crimped connectors, spring clamp connectors, etc.), epoxy connections, magnetic connections, etc.

The connector 218 may be configured to be disposed within the coupling region 202 of the earth-boring tool 200. In some embodiments, the connector 218 and tool wiring 216 may be configured to enable the connector 218 to be removed from the coupling region 202 of the earth-boring tool 200 a distance sufficient to couple and/or decouple the tool wiring 216 to the connector 218. For example, during assembly the tool wiring 216 may be coupled to the connector 218 with the connector 218 removed from the coupling region 202 of the earth-boring tool 200. In some embodiments, an operator may similarly remove the connector 218 from the coupling region 202 of the earth-boring tool 200 for troubleshooting the sensors 208 in the tool body 204 and/or replacing one or more sensors 208 in the tool body 204.

In some embodiments, the connector 218 may include an integral electronic device 222. For example, the connector 218 may include a local sensor such as, a temperature sensor, thermocouple, vibration sensor, magnetometer, accelerometer, gyrometer, etc. In some embodiments, the connector 218 may include a storage device, such as a data storage device (e.g., memory) or a power storage device (e.g., battery, rechargeable battery pack, capacitor, etc.). In some embodiments, the connector 218 may include a wireless transmitter/receiver or an antenna. For example, the earth-boring tool 200 may be configured to communicate wirelessly with another component of the drill string through radio waves, etc.

The connector 218 may be configured to enable a removable connection with an adjacent connector 224 (e.g., a complementary connector). For example, the removable connection may include a plug socket connection, a pin connection, jack and plug connections, blade and socket, etc. In some embodiments, the connector 218 may be a female connection (e.g., socket, terminal, jack, etc.) configured to receive a male connection (e.g., plug, pin, blade, etc.) of the adjacent connector 224. In some embodiments, the connector 218 may be a male connection configured to be received into a female connection of the adjacent connector 224. In some embodiments, each of the connector 218 and the adjacent connector 224 may include some male connections and some female connections. For example, the female and male connections may be configured to key the connection between the connector 218 and the adjacent connector 224, such that the connector 218 and the adjacent connector 224 may only be connected in one orientation. In some embodiments, the connector 218 and the adjacent connector 224 may include other locating features. For example, the connector 218 and the adjacent connector 224 may include locator pins configured to restrict the connection between the connector 218 and the adjacent connector 224, such that the connector 218 and the adjacent connector 224 may only be connected in one orientation. In some embodiments, the connector 218 and the adjacent connector 224 may include external features such as a key and complementary groove, configured to restrict the connection between the connector 218 and the adjacent connector 224, such that the connector 218 and the adjacent connector 224 may only be connected in one orientation.

The adjacent connector 224 may include a connection ledge 230. The connection ledge 230 may be configured to interface directly with the connector 218. For example, the connection ledge 230 may include one or more connections, such as sockets or pins. The adjacent connector 224 may also include a base 232 configured to pass through the connector 218. For example, in some embodiments, the connector 218 may have an annular shape such that the base 232 may pass through a central region of the connector 218.

The connector 218 and the adjacent connector 224 may include one or more seals 226, 228, such as O-rings, configured to substantially prevent fluid from entering the connection between the connector 218 and the adjacent connector 224. For example, the adjacent connector 224 may include an outer seal 226 and an inner seal 228 configured to provide a liquid seal between the adjacent connector 224 and the connector 218 and a seal between the adjacent connector 224 and the coupling region 202 of the earth-boring tool 200. In some embodiments, one or more of the seals 226, 228 may include an elastomeric material, such as polytetrafloroethelyne (PTFE), ethylene propylene diene monomer (EPDM), silicone rubber, polychlorpoprene (e.g., neoprene or pc-rubber), acrylonitrile butadiene rubber (e.g., NBR, Buna-N, or nitrile rubber), etc.

Figure 3:
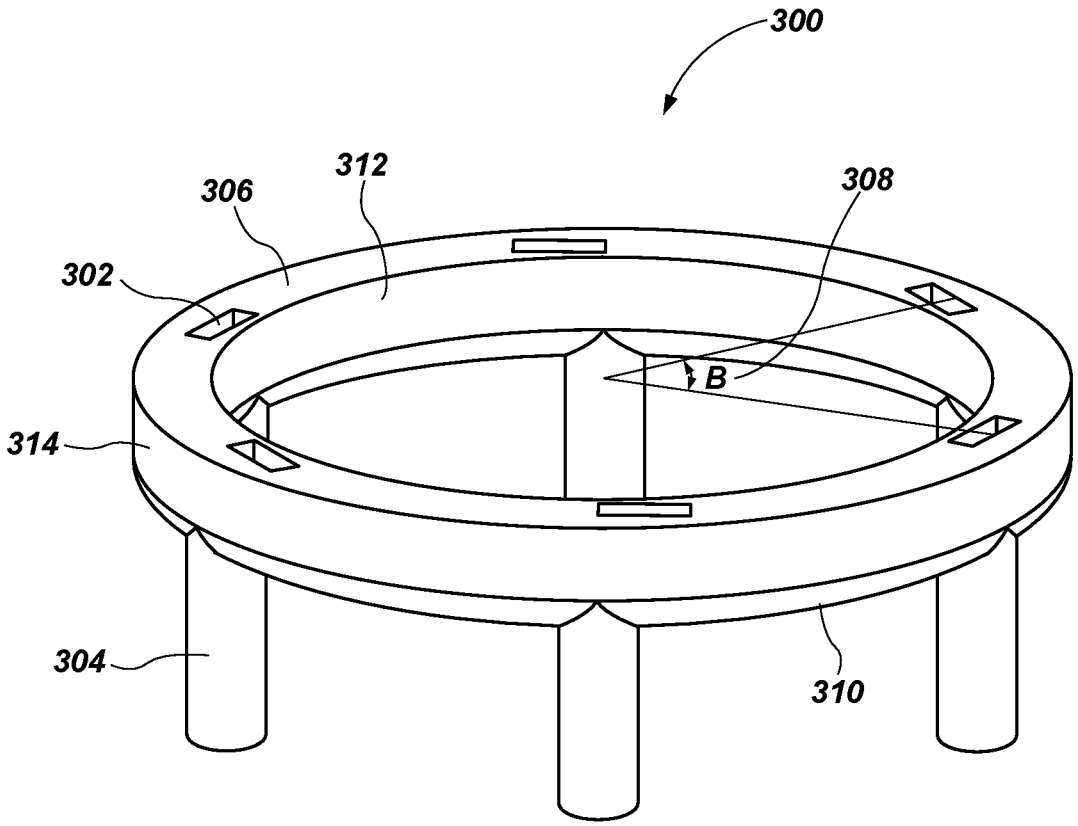
FIG. 3 illustrates a connector in accordance with an embodiment of the present disclosure.

For example, FIG. 3 illustrates an embodiment of a connector 300. The connector 300 may be substantially annular in shape, forming a ring. The connector 300 may include one or more sockets 302 arranged about a top surface 306 of the connector 300. The sockets 302 may be configured to receive connecting pins from a complementary connector. In some embodiments, the sockets 302 may be arranged in a single annular ring about the top surface 306 of the connector 300.

In some embodiments, the sockets 302 may be substantially evenly spaced about the top surface 306 of the connector 300. For example, a displacement angle 308 between two adjacent sockets 302 may be substantially the same as a displacement angle 308 between two different adjacent sockets 302. The displacement angle 308 may be between about one degree and about ninety degrees, such as between about one degree and about thirty degrees, between about two degrees and about twenty degrees, or between about two degrees and about ten degrees.

The connector 300 may include one or more ports 304 (e.g., wire passageways) extending from a lower surface 310 of the connector 300. The ports 304 may be configured to receive one or more wires from the tool wiring 216 (FIG. 2). For example, the ports 304 may be configured to arrange the one or more wires, such that the one or more wires enter the connector 300 in a region near where the wires will be coupled to the connector 300. In some embodiments, the ports 304 may be configured to provide a protected passageway from the internal passage 212 of the earth-boring tool 200 (FIG. 2) to the connector 300.

In some embodiments, the connector 300 may include up to the same number of ports 304 as associated electronic devices in the associated earth-boring tool. For example, each port 304 may be associated with an individual electronic device. In some embodiments, each port 304 may be configured to receive wiring from multiple electronic devices. In some embodiments, the ports 304 may be associated with connection points in the connector 300 rather than the individual electronic devices.

In some embodiments, the connector 300 may be configured to receive specific types of connections in specific areas. Separating the connector 300 into specific regions may enable a connector to be substantially universal such that one connector 300 may be integrated into multiple different earth-boring tools without requiring any major modifications. Similarly, a universal connector may enable a universal complementary connector to be used in adjoining components of the drill string or BHA such that no wiring changes are required when changing an earth-boring tool or component. The specific areas may include, for example, a power bus, a reference bus (e.g., neutral, ground, reference voltage, etc.), specific types of signals, such as Direct Current (DC) voltage signals (e.g., 0-5 VDC, 0-10 VDC, etc.), current signals (e.g., 0-20 mA, 4-20 mA, etc.), resistance signals (e.g., resistance temperature detectors (RTD), etc.), and communication signals (e.g., network communication). For example, one port 304 may be configured to receive only power connections and another port 304 may be configured to receive only a specific type of signal (e.g., Direct Current (DC) signals, current signals, resistance signals, etc.).

In some embodiments, the connector 300 may include a feature configured to key the connector 300 such that a complementary connector may only connect to the 300 in one unique manner. Keying the connector 300 may enable two substantially universal connectors to be connected in the same manner regardless of what the earth-boring tool is connecting to, such that when the connector 300 is separated into specific regions, a complementary connector may be similarly separated into specific regions and always be connected to the matching regions in the connector 300.

In some embodiments, the connector 300 may include an identifying feature. For example, one of the sockets 302 may be configured to provide a signal to a processor coupled through the complementary connector that identifies the earth-boring tool 200 associated with the connector 300 and a configuration of the sensors 208 in the earth-boring tool 200 such that the processor may translate the data provided through the connector 300 correctly.

The connector 300 may be encased in and/or formed from an insulating material. For example, the connector 300 may be formed from a polymer material, such as polyethylene, polyvinyl chloride, polytetrafluoroethylene (PTFE), etc. In some embodiments, the connector 300 may be formed from a rubber material, such as ethylene propylene diene monomer (EPDM), silicone rubber, polychlorpoprene (e.g., neoprene or pc-rubber), acrylonitrile butadiene rubber (e.g., NBR, Buna-N, or nitrile rubber).

Figure 4:
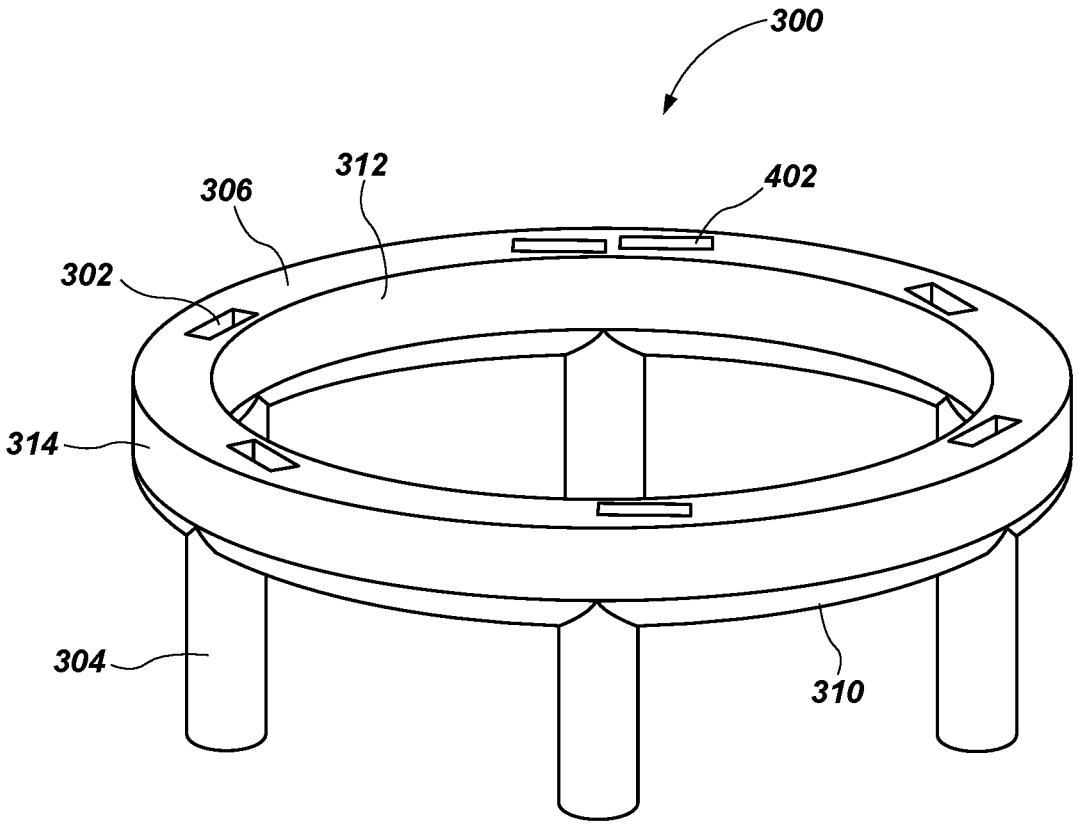
FIG. 4 illustrates a connector in accordance with an embodiment of the present disclosure.

FIG. 4 illustrates an embodiment of the connector 300 including a key socket 402. The key socket 402 may be positioned on the top surface 306 of the connector 300 such that a distance between the key socket 402 and the adjacent sockets 302 is different than the distance between the other sockets 302. For example, as illustrated in FIG. 4, the key socket 402 may be substantially closer to an adjacent socket 302, such that a complementary connector would similarly require one pin to be positioned substantially closer to an adjacent pin to successfully connect to the connector 300. In some embodiments, rather than including a key socket 402, one socket of the sockets 302 may be omitted such that a distance between two adjacent sockets 302 is double the distance between all other adjacent sockets 302. Similarly, this may require a complementary connector to remove one pin to be able to successfully connect to the connector 300.

In some embodiments, a key feature may be formed into a side surface of the connector 300, such as an inside surface 312 of the connector 300 or an outside surface 314 of the connector 300. For example, at least one of the inside surface 312 or the outside surface 314 may include a vertical groove. The complementary connector may include a complementary ridge or protrusion configured to be received in the groove formed in the connector 300. In some embodiments, at least one of the inside surface 312 and the outside surface 314 may include a substantially vertical ridge and the complementary connector may include a complementary groove configured to be receive the ridge formed in the connector 300

Figure 5:
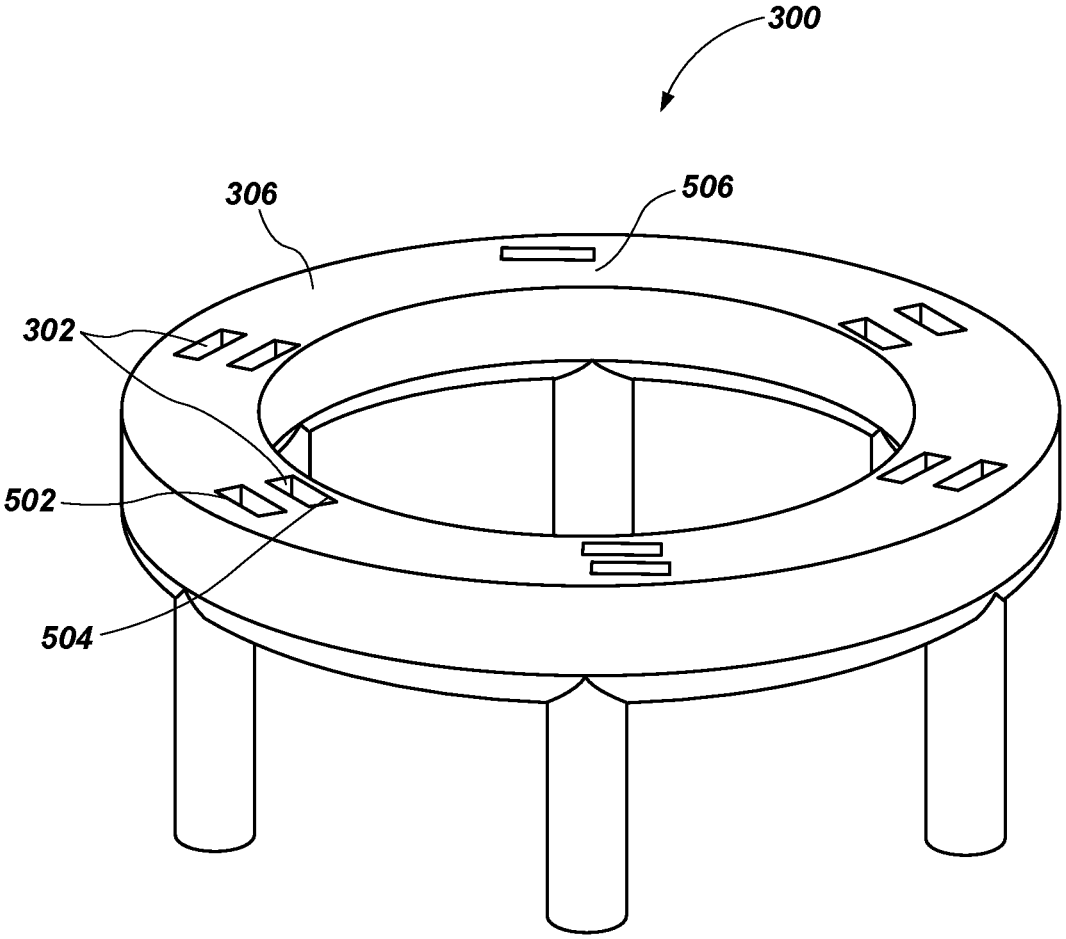
FIG. 5 illustrates a connector in accordance with an embodiment of the present disclosure.

FIG. 5 illustrates an embodiment of a connector 300. The connector 300 may include a plurality of sockets 302 arranged annularly about the connector 300 in a top surface 306 of the connector 300. In some embodiments, the sockets 302 may be arranged in multiple concentric rings. For example, the sockets 302 may be arranged in an outer ring 502 and an inner ring 504. In some embodiments, the sockets 302 in the outer ring 502 may be insubstantially the same radial position as the sockets 302 in the inner ring 504, as illustrated in FIG. 5. In some embodiments, the sockets 302 in the outer ring 502 may be radially offset from the sockets 302 in the inner ring 504.

In some embodiments, one or more of the outer ring 502 of sockets 302 and the inner ring 504 of sockets 302 may include a key feature 506. As illustrated in FIG. 5, the key feature 506 may be formed when one or more sockets 302 of the outer ring 502 or the inner ring 504 is omitted such that a distance between two adjacent sockets 302 is double the distance between the other adjacent sockets 302. As described above, the key feature 506 may require that a complementary connector includes a similar discontinuity in the pins such that the complementary connector may successfully connect to the connector 300.

Figure 6:
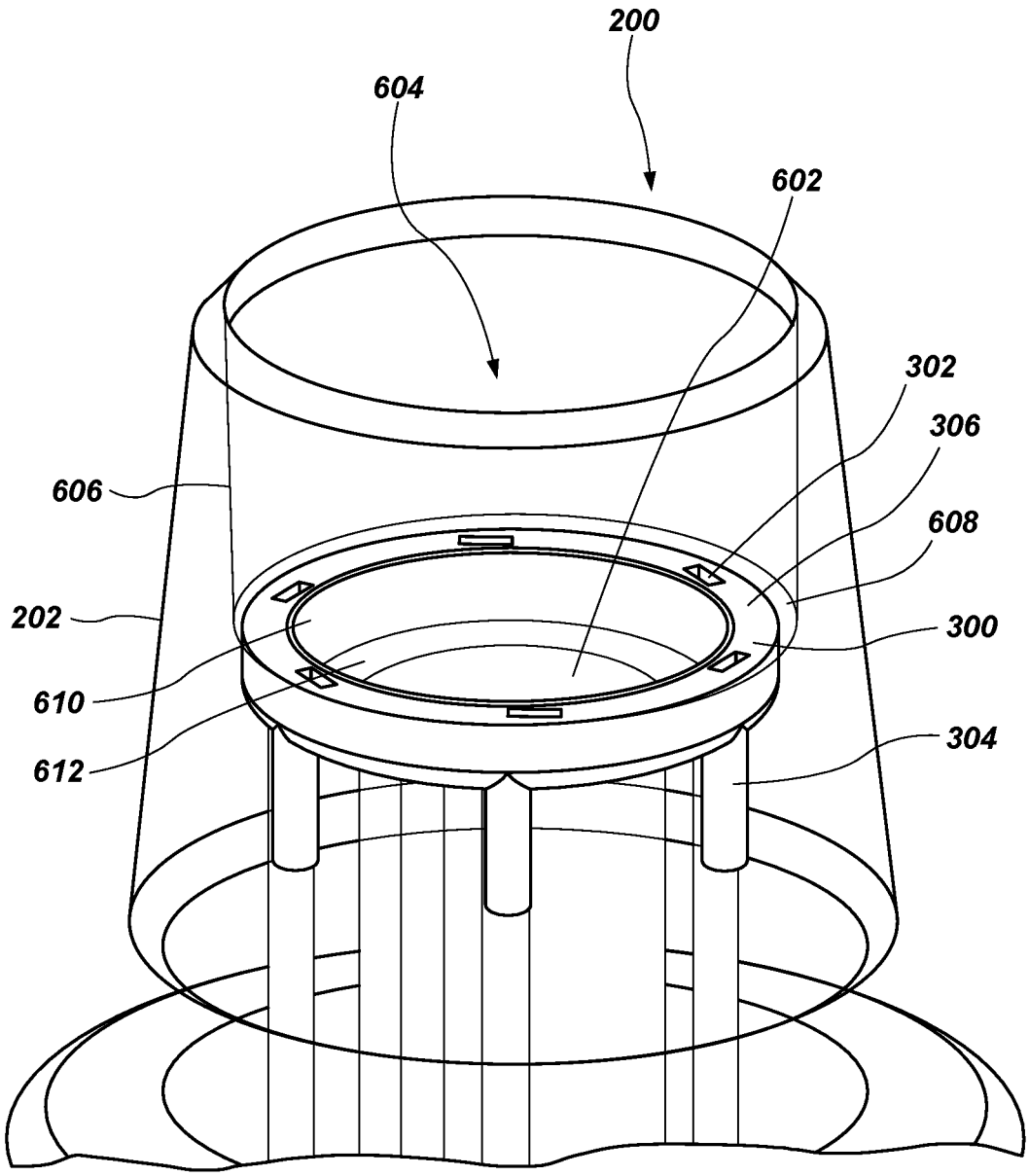
FIG. 6 illustrates the coupling region of an earth-boring tool in accordance with an embodiment of the present disclosure.

FIG. 6 illustrates a close up view of the coupling region 202 of the earth-boring tool 200. The coupling region 202 may include a fluid passageway 602 configured to enable drilling fluid from the drill string to pass through the earth-boring tool 200. The coupling region 202 may further include a cavity 604 that is substantially larger in diameter than the fluid passageway 602. The cavity 604 may be configured to receive the connector 300. For example, an outer wall 606 may define a diameter of the cavity 604 that is greater than a diameter of the connector 300 such that the connector 300 may be disposed within the cavity 604 of the coupling region 202.

The coupling region 202 may include a receptacle 608 within the cavity 604 configured to receive the connector 300. The receptacle 608 may have a complementary annular shape to the connector 300 defined between the outer wall 606 of the cavity 604 and a receptacle wall 610. For example, the receptacle wall 610 may be positioned a distance from the outer wall 606 that is substantially the same as a radial thickness of the connector 300 such that the connector 300 may be received between the outer wall 606 and the receptacle wall 610 in the receptacle 608. The receptacle wall 610 may substantially isolate the receptacle 608 and the connector 300 from the fluid passageway 602. The receptacle wall 610 may extend to a recess ledge 612. The recess ledge 612 may extend radially inward spanning the distance between the receptacle wall 610 and the fluid passageway 602. In some embodiments, the connector 300 may be configured to form a seal between the connector 300 and the receptacle 608, such that the seal may substantially prevent fluid from entering the internal passages 212 and/or damaging electronic components in the connector 300 and other electronic devices in the tool body 204.

Now referring to FIG. 2 and FIG. 6, the adjacent connector 224, may be configured to be disposed into the cavity 604. For example, the outer seal 226 may be configured to abut against the outer wall 606 to form a seal between the outer wall 606 and the adjacent connector 224. The inner seal 228 may be configured to abut against the receptacle wall 610 to form a seal between the receptacle wall 610 and the adjacent connector 224. The base 232 may be configured to rest against the recess ledge 612 and the connection ledge 230 may be configured to rest against the top surface 306 of the connector 300. In some embodiments, the connection ledge 230 may include one or more pins configured to interface with (e.g., be received into) the sockets 302 in the top surface 306 of the connector 300.

Figure 7:
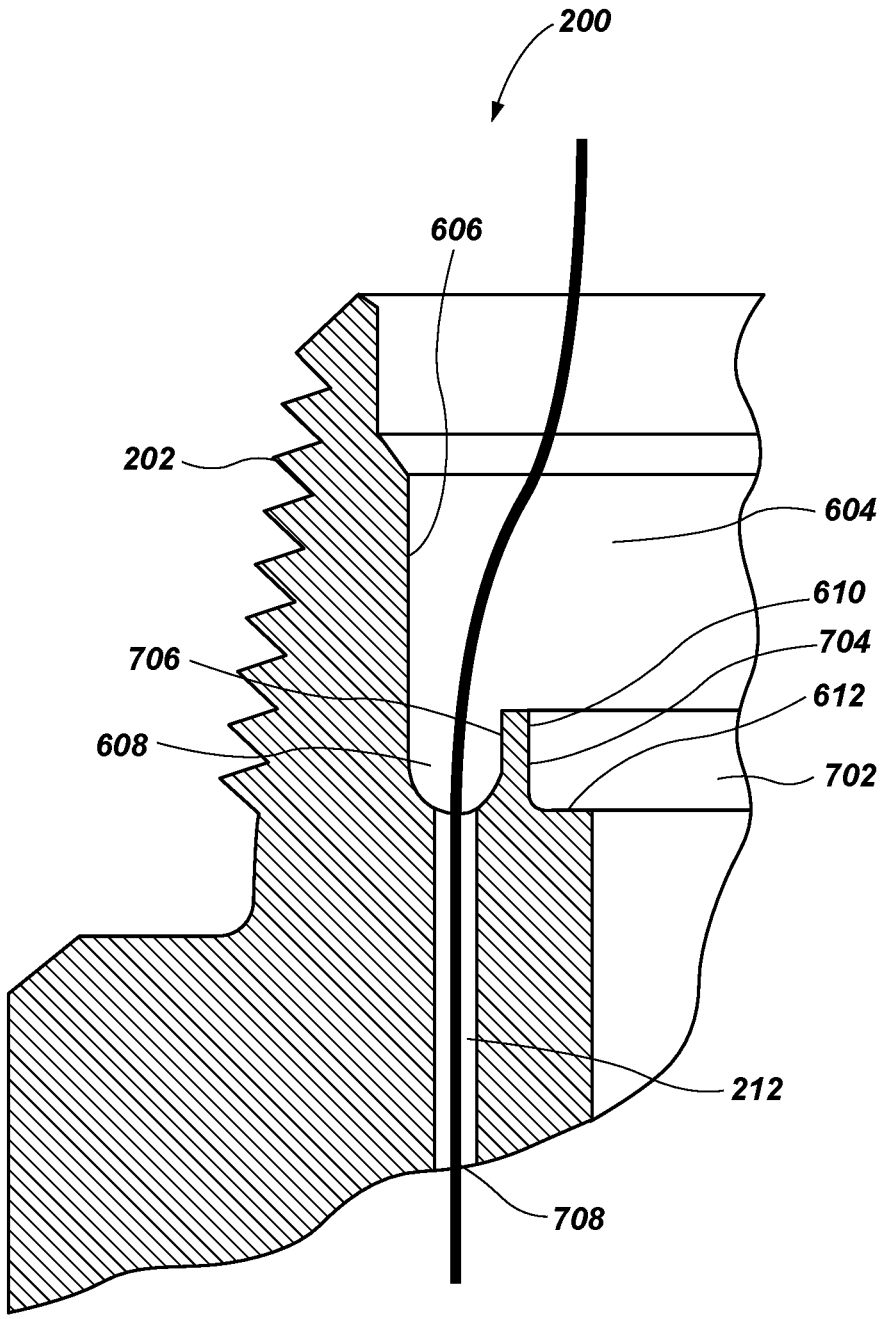
FIG. 7 illustrates a cross sectional view of a portion of the coupling region of an earth-boring tool in accordance with an embodiment of the present disclosure.

FIG. 7 illustrates a cross sectional view of a portion of the coupling region 202 of the earth-boring tool 200. The coupling region 202 may include a cavity 604 defined within the coupling region 202. The cavity 604 may be defined by an outer wall 606. The cavity 604 may include a recessed portion 702. The recessed portion 702 may be defined by a receptacle wall 610 and a recess ledge 612, such that the recessed portion 702 is substantially smaller in diameter than the cavity 604.

The cavity 604 may also include a receptacle 608 configured to receive the connector 300 (FIGS. 3-6). The receptacle 608 may be defined between the outer wall 606 and the receptacle wall 610. For example, the receptacle 608 may be defined between the outer wall 606 and a receptacle surface 706 of the receptacle wall 610 and the recessed portion 702 may be defined by a recess surface 704 of the receptacle wall 610 opposite the receptacle surface 706. The receptacle 608 may have a complementary shape to the connector 300 (FIG. 3). For example, the distance between the outer wall 606 and the receptacle surface 706 of the receptacle wall 610 may be substantially the same as the distance between the outside surface 314 and the inside surface 312 of the connector 300 (FIG. 3), such the connector 300 may fit between the outer wall 606 and the receptacle wall 610.

The coupling region 202 may include one or more internal passages 212 passing from the coupling region 202 to the tool body 204 (FIG. 2) of the earth-boring tool 200. The internal passages 212 may be configured to receive wiring 708 between the connector 300 and the tool body 204. In some embodiments, the internal passage 212 may be configured to receive additional electronic devices coupled directly to the connector 300 such as thermocouples, temperature sensors, pressure sensors, vibration sensors, antennas, etc. In some embodiments, the internal passage 212 may be configured to receive the ports 304 extending from the lower surface 310 of the connector 300 (FIG. 3). For example, the internal passage 212 may have a diameter that is substantially the same as or slightly larger than an outside diameter of the ports 304, such that the ports 304 may be at least partially disposed into the internal passage 212 from the receptacle 608. The wiring 708 and/or additional electronic devices may pass from the connector 300 to the internal passage 212 through the corresponding ports 304.

Figure 8:
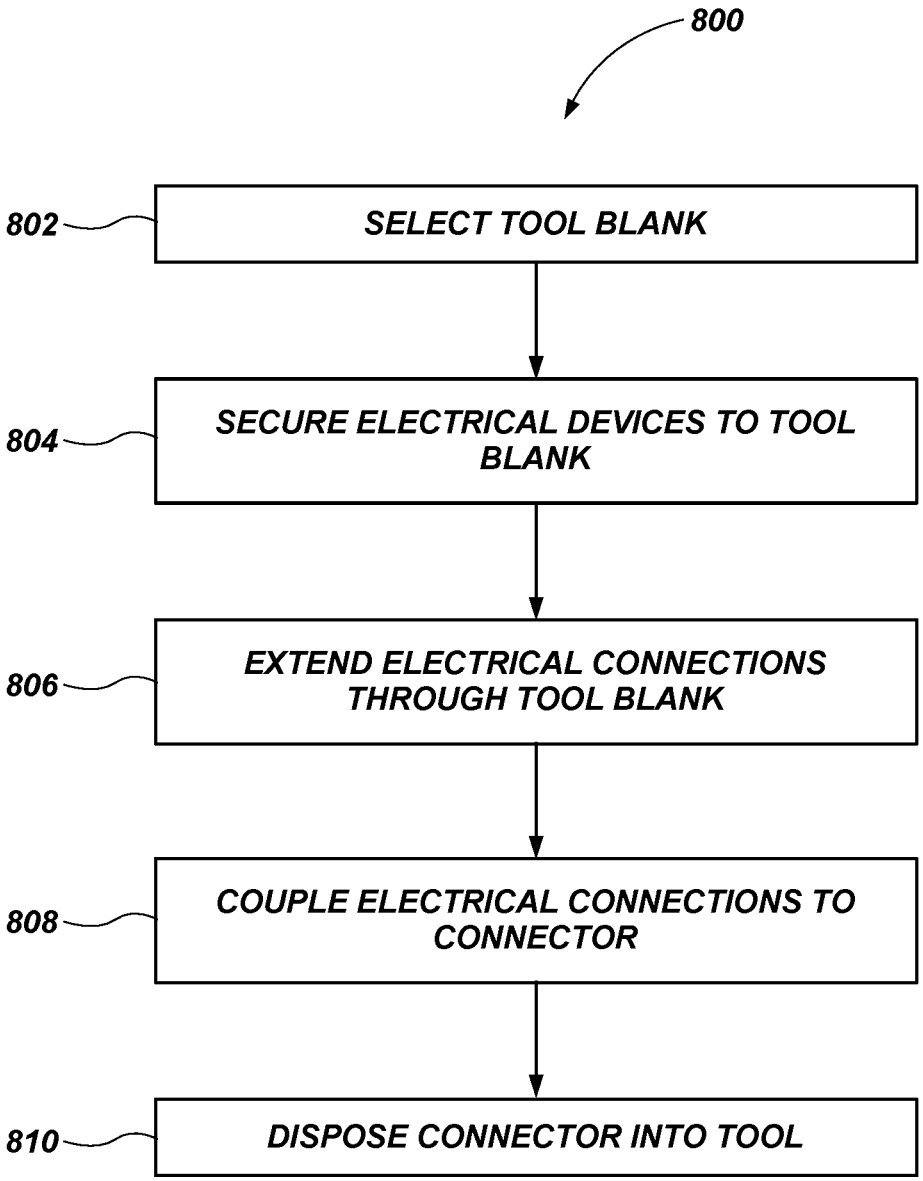
FIG. 8 illustrates a flow chart representative of a method of building an earth-boring tool in accordance with an embodiment of the present disclosure.

FIG. 8 illustrates a method of building an earth-boring tool 800. Referring also to FIGS. 2-7. The earth-boring tool may be selected from a collection of tool blanks in act 802. The tool blanks may include an earth-boring tool body formed from a particle-matrix composite material, or a metal material, such as steel. The tool blanks may be formed through a molding, forging, and/or machining process. The tool blanks may go through additional machining processes. For example, pockets configured to house different electrical devices, such as sensors, processors, controllers, etc. may be machined into the tool blanks. In some embodiments, pockets configured to receive cutting elements may be machined into surfaces of the tool body. Further machining may include removing material to form one or more internal passages 212 through the tool blank. For example, an internal passage 212 formed into the tool blank may be configured to receive wiring from the electronic devices. In some embodiments, a cavity 604 may be machined into a coupling region 202 of the tool blank. The cavity may be configured to include a receptacle 608 for receiving the connector 300.

Electrical devices such as sensors, processors, controllers, etc. may be secured to the tool blank in act 804. In some embodiments, the electrical devices may be secured in pockets formed in a surface of the tool blank. In some embodiments, the electrical devices may be disposed into one or more cavities formed in the body of the tool blank. In some embodiments, the electrical devices may be disposed in other elements that may be separately attached to the tool blank, such as cutting elements, nozzles, etc. The electrical devices may include electrical connections, such as wires, cables, fiber optics, etc. extending from the electrical devices and configured to connect the electrical devices to another electronic device, such as a module, processor, memory device, power supply, etc.

The electrical connections may be extended through the tool blank in act 806. For example, the electrical connections may be inserted into an internal passage 212 formed in the tool blank during the machining processes. In some embodiments, the electrical connections may be inserted into protective sleeves or conduits that may be disposed on or in the tool blank. The passageways in the tool blank may enable the electrical connections to pass from the electrical devices to a central region of the tool blank. For example, multiple internal passages 212 may converge into one or more main internal passages 212 extending in an axial direction of the tool blank. The main internal passages 212 may be configured to correspond to one or more ports 304 of the connector 300.

The electrical connections may be coupled to the connector 300 in act 808. For example, the electrical connections may be inserted into the connector 300 through the ports 304. The electrical connections may then be at least semi-permanently coupled to the connector 300. For example, the electrical connections may be coupled to the connector 300 through a soldered connection, brazed connection, punch-down connection, screw terminal connection, binding post connection; lug connection, compression connection, etc., or a combination of multiple different connections.

The connector 300 may be disposed into the cavity 604 of the earth-boring tool 200 in act 810. In some embodiments, the electrical connections may enable the connector 300 to be removed from cavity 604 of the earth-boring tool 200 a distance sufficient to enable an operator to make connections, remove connections, repair connections, and/or troubleshoot connections with the connector 300 outside of the cavity 604 of the earth-boring tool 200. In some embodiments, the connector 300 may be configured to enable the operator to make connections, remove connections, repair connections, and/or troubleshoot connections without removing the connector 300 from the cavity 604 of the earth-boring tool 200. As discussed above, the connector 300 may be configured to enable a removable connection with an adjacent connector 224.

Embodiments of the present disclosure may enable an operator in the field to quickly change an earth-boring tool without the complexity of disconnecting and/or connecting all of the wires between the earth-boring tool and an adjacent component. A universal connector may enable the operator to connect the earth-boring tool to the adjacent component through a single connection. The simplicity of the single connection may reduce the amount of time required to change an earth-boring tool. The simplicity of the connection may also enable a less skilled technician to complete an otherwise complex job reducing operation costs.

Embodiments of the present disclosure may also enable all of the complex wiring of sensors and/or electronic devices to be completed and/or tested during the manufacturing process, such that no complex wiring is required in the field. The conditions in the manufacturing process may enable the complex wiring to be completed more efficiently.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. An earth-boring tool comprising:

a tool body;

a coupling region configured to couple the earth-boring tool to an adjacent portion of a drill string;

a fluid passage defined within the coupling region;

one or more sensors disposed on the tool body; and a connector comprising:

a ring disposed in the coupling region concentrically about the fluid passage;

two or more sockets disposed in a surface of the ring and evenly spaced annularly about the ring; and a key socket disposed in the surface of the ring, the key socket positioned such that a distance between the key socket and an adjacent socket is different from a distance between the evenly spaced two or more sockets;

wherein the connector is electrically connected to the one or more sensors, the connector configured to enable a removable connection from an external device to the one or more sensors, and a recess formed in the coupling region of the tool body facing the fluid passage, the recess configured to receive a portion of a complementary connector and align the complementary connector with the connector.

2. The earth-boring tool of claim 1, wherein the connector comprises an insulating material.

3. The earth-boring tool of claim 1, wherein the connector comprises one or more connection ports disposed annularly about the ring.

4. The earth-boring tool of claim 1, wherein the connector comprises one or more wire passageways.

5. The earth-boring tool of claim 4, wherein the one or more sensors comprise electrical wires disposed in the one or more wire passageways.

6. The earth-boring tool of claim 1, wherein the connector comprises an electronic device directly coupled to the connector.

7. The earth-boring tool of claim 6, wherein the electronic device comprises a storage device.

8. The earth-boring tool of claim 6, wherein the electronic device comprises a local sensor.

9. The earth-boring tool of claim 1, further comprising a cavity in the coupling region of the earth-boring tool, wherein the cavity comprises a receptacle having a larger diameter than the fluid passage.

10. The earth-boring tool of claim 9, wherein the receptacle is configured to receive the connector and the receptacle is substantially isolated from the fluid passage by a receptacle wall.

11. A drill string comprising:

an earth-boring tool comprising:

a tool body;

a coupling region configured to couple the earth-boring tool to an adjacent portion of the drill string;

one or more electronic devices disposed in the drill string; and a connector comprising a ring disposed in the coupling region of the earth-boring tool electrically coupled to the one or more electronic devices; and a complementary connector disposed in the adjacent portion of the drill string, wherein the complementary connector is electrically coupled to a data processing device; and the complementary connector including an annular protrusion having a diameter less than the ring of the connector configured to align the complementary connector concentrically with the connector;

wherein the connector and the complementary connector are configured to electrically couple the one or more electronic devices to the data processing device.

12. The drill string of claim 11; wherein at least one of the connector and the complementary connector comprise a male connection and the other of the connector and the complementary connector comprises a female connection.

13. The drill string of claim 11; wherein the connector comprises a keyed feature.

14. The drill string of claim 13; wherein the connector comprises a plurality of terminals positioned at substantially equal intervals.

15. The drill string of claim 14; wherein the keyed feature comprises an omitted terminal.

16. The drill string of claim 14; wherein the keyed feature comprises one or more terminals positioned at a different distance to an adjacent terminal than the substantially equal intervals between the plurality of terminals.

17. The drill string of claim 11; wherein the connector is configured to form a seal between the connector and the coupling region of the earth-boring tool.

18. A method of building an earth-boring tool comprising:

selecting an earth-boring tool blank;

securing one or more electrical devices to the earth-boring tool blank;

extending electrical connections from the electrical devices through the earth-boring tool blank into a central region of the earth-boring tool blank;

electrically coupling the electrical connections semi-permanently to two or more sockets and a key socket on an annular connector, the two or more sockets disposed in a surface of the annular connector and evenly spaced annularly about the connector; and the key socket disposed in the surface of the connector, the key socket positioned such that a distance between the key socket and an adjacent socket is different from a distance between the evenly spaced two or more sockets; and disposing the annular connector around a recess formed in a coupling region of the earth-boring tool blank facing a fluid passage through the earth-boring tool, wherein the annular connector is configured to enable a removable connection between the electrical devices and another earth-boring tool component, the recess in the coupling region configured to receive a portion of a complementary connector of the another earth-boring tool component.

19. The method of claim 18, further comprising machining one or more passageways through the earth-boring tool, wherein the one or more passageways are configured to enable the electrical connections to pass through the earth-boring tool blank into the central region of the earth-boring tool blank.

20. The method of claim 18, wherein coupling the electrical connection semi-permanently to the annular connector comprises one or more of soldering, brazing, attaching through a punch-down connection, attaching through a screw terminal, attaching through a binding post; attaching through a lug, and attaching through a compression connection.

* * * * *